US005492319A

United States Patent [19]

Lee

[11] Patent Number: 5,492,319

[45] Date of Patent: Feb. 20, 1996

[54] INDOOR GOLF CHIP SHOT PRACTICE APPARATUS

[76] Inventor: Sung C. Lee, 1675 Henley Ct., Wheeling, Ill. 60090

[21] Appl. No.: 327,003

[22] Filed: Oct. 11, 1994

[51] Int. Cl.[6] ..... A63B 69/36

[52] U.S. Cl. ..... 273/181 F

[58] Field of Search ..... 273/181 F, 1.5 R, 273/1.5 A, 401, 402

[56] References Cited

U.S. PATENT DOCUMENTS

| | | | |
|---|---|---|---|
| 2,582,290 | 1/1952 | Smith . | |
| 3,310,313 | 3/1967 | Colson | 273/180 |
| 4,336,939 | 6/1982 | Krumlauf | 273/185 R |
| 4,511,146 | 4/1985 | Windall | 273/181 F X |
| 4,556,219 | 12/1985 | Tillery | 273/181 F |
| 4,643,423 | 2/1987 | Wright | 372/181 F X |
| 4,750,744 | 6/1988 | Michalec | 273/181 F X |
| 4,880,239 | 11/1989 | Lemeveu | 273/181 F |
| 5,116,056 | 5/1992 | Schmutte | 273/181 F |
| 5,180,167 | 1/1993 | Felix | 273/181 F |
| 5,286,029 | 2/1994 | Smit | 273/181 F |

*Primary Examiner*—William H. Grieb

[57] ABSTRACT

An indoor golf chip shot practice apparatus which is to be used for practicing chip shots in the game of golf. The apparatus comprises a rectangular prism shape safety net with only one opening to the side of the user, therefore, the golf ball stays inside of the safety net even in case of bad shots. The apparatus also comprises a frame to support and encompass the safety net and is designed in such a way that the golf ball rolls back on the floor of the safety net to the user after each shot.

3 Claims, 3 Drawing Sheets

INDOOR GOLF CHIP SHOT PRACTICE APPARATUS

BACKGROUND OF THE INVENTION

1. Field of the Invention

The present invention relates to a golf shot practice device and, in particular, to a device which is small in size and has safety features. Said invention, therefore, can be used safely indoors in a living room or an office even by novice golfers.

2. Prior Art

Various devices for practicing golf shots have been developed over the years. There are putting practice devices such as the apparatus shown in U.S. Pat. No. 2,582,290 issued to Smith and U.S. Pat. No. 3,310,313 issued to Colson. None of these inventions are, however, suited for chip shot practice. Since a golfer rolls the ball when he putts, even the worst hit putt will not fly as in chip shots.. Thus, putting devices cannot provide safety when they are used for chip shot practice.

Other devices for practicing full swing golf shots, such as U.S. Pat. No. 4,511,146 issued to Windall, U.S. Pat. No. 4,880,239 issued to Leneveu, U.S. Pat. No. 5,116,056 issued to Schulle, and U.S. Pat. No. 5,180,167 issued to Felix, but they are bulky and not suitable for indoor practice.

U.S. Pat. No. 4,336,939 issued to Kraumlauf discloses a complex clip for putt and chip practice device, and U.S. Pat. No. 5,286,029 issued to Smit shows simple features for chipping practice. Those devices, however, lack safety features for use indoors. They cannot guarantee safety to surroundings when "shank" (a phenomenon that a golf ball flies far to the right soon after hit by the hill of golf club head) or "topping" (a phenomenon that golf ball rolls very fast when smothered on top by golf club head) occurs, which is not uncommon among average golfers.

The aforementioned patents reflect state of the art design of which the applicant is aware and it is respectfully stipulated that none of these patents teach or render obvious, singly or in combination, applicant's claimed invention.

SUMMARY OF THE INVENTION

This invention pertains to an indoor golf chipping practice apparatus, the object of which is to let users practice chip shots safely indoors.

One of the objectives of this invention is to provide a device which is simple in design so the chance of a glitch are minimal.

Another objective of the invention is to provide a device which automatically returns a golf ball to the user so the user needs only one ball for repeat practice.

Another purpose for this invention is to provide a device which is small in size and lightweight so when it is not in use, it can be stored or carried easily.

These and other objectives are provided by the present invention which is comprised of a safety net, an exterior frame to support and encompass the safety net, and a mat on which a golf ball is placed.

The safety net is made from a fabric or fabric-like flexible material. Said net, when fully stretched for use, is a rectangular prism with one open end so that the ball enters into the safety net.

The frame is made of light yet firm material such as plastic tubing or aluminum stripping. Said frame, when assembled, stands on its own and holds the safety net inside. Said frame is made in such a way that when the safety net is hung inside, the floor of the safety net is on an incline toward the opening so that when the golf ball hits the left-hand side enclosure of the safety net, it rolls down to the user automatically.

The mat is made of flexible material such as ordinary carpet or rubber-like material.

An embodiment of the invention is described in detail in the following specification which refers to the accompanying drawings.

DETAILED DESCRIPTION OF THE PREFERRED EMBODIMENTS

Figure 1:
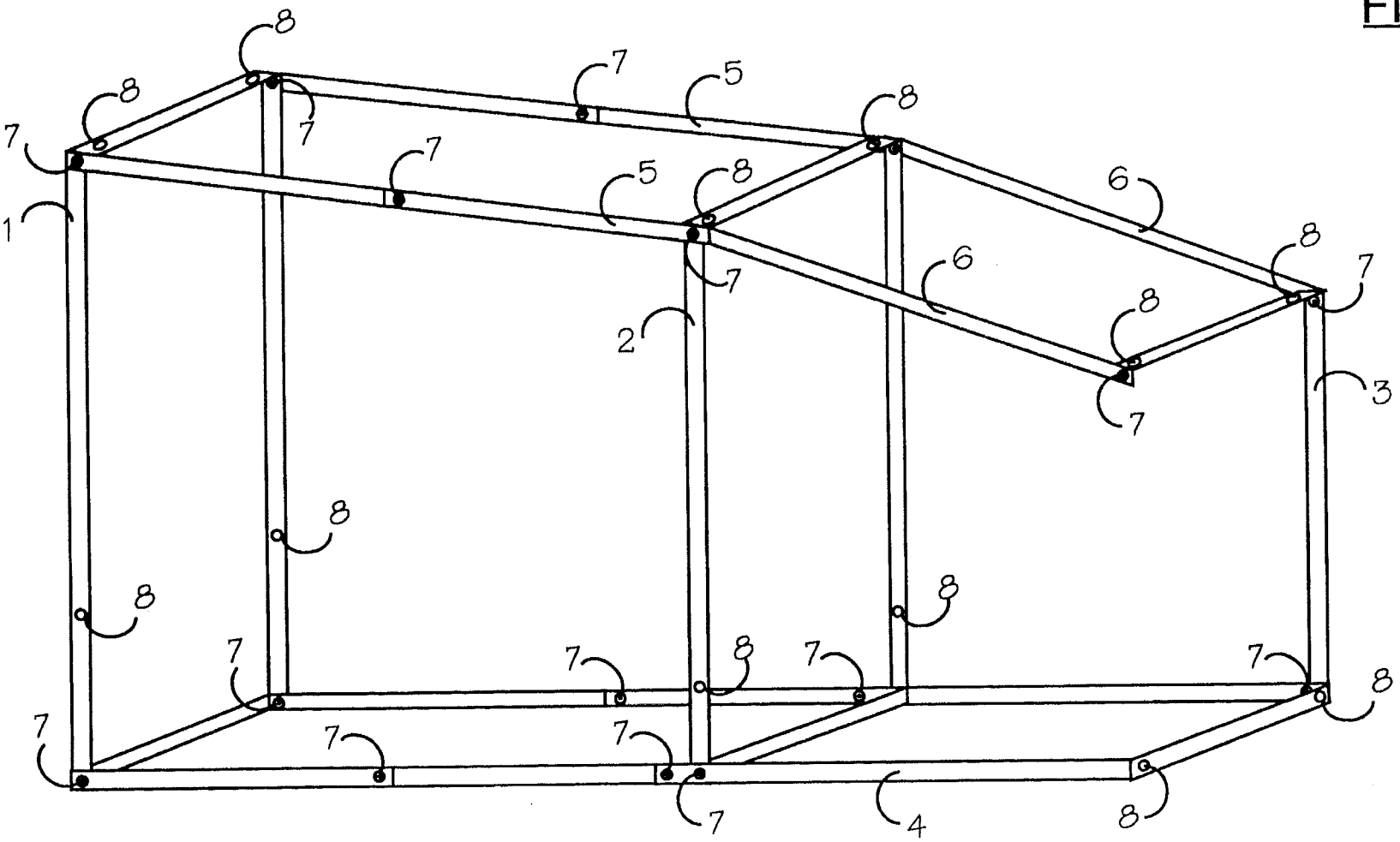
FIG. 1 shows a perspective view of the frame.

Referring to FIG. 1, the tallest wicket [1] (leg length 3 ft. and bar length 1 ft.) is erected perpendicularly on the left-hand side end of the base [4] and screwed with bolts and lug nuts [7]. The second wicket [2] (leg length 2 ft. 10 in. and bar length 1 ft.) is erected in the same manner on the base [4], three feet from the wicket [1] and a hook [3] is erected on the other end of the base with only one leg screwed on the far side from the user. A hook [3] (leg length 2 ft. and bar length 1 ft.) is erected on the far side from the user so that the follow-through of the golf club will not be hindered. The base [4] (full size 5 ft.×1 ft.) can be folded by unscrewing bolts and nuts [7] so that minimal storage space in needed when not in use. Both wickets [1 and 2] are reinforced by a cross bar [5], which also can be folded in the middle by unscrewing, with corresponding corners and ends being screwed together. Wicket 2 and the hook [3] are reinforced the same way by bars [6].

There are four holes [8] (diameter of ⅛ in.) on both wickets [1 and 2], two holes on the hook [3], and two on the side end of the base [4]. Two holes in the bar of the first wicket [1] are to be as far apart from each other as possible and two holes on each leg are 2 ft. 6 in. from the top. Two holes in the bar of the second wicket [2] are to be as far apart from each other as possible and two holes on each leg are 2 ft. 6 in. from the top. Two holes in the bar ofthe hook [3] and two holes in the base are as far apart as possible from each other.

Figure 2:
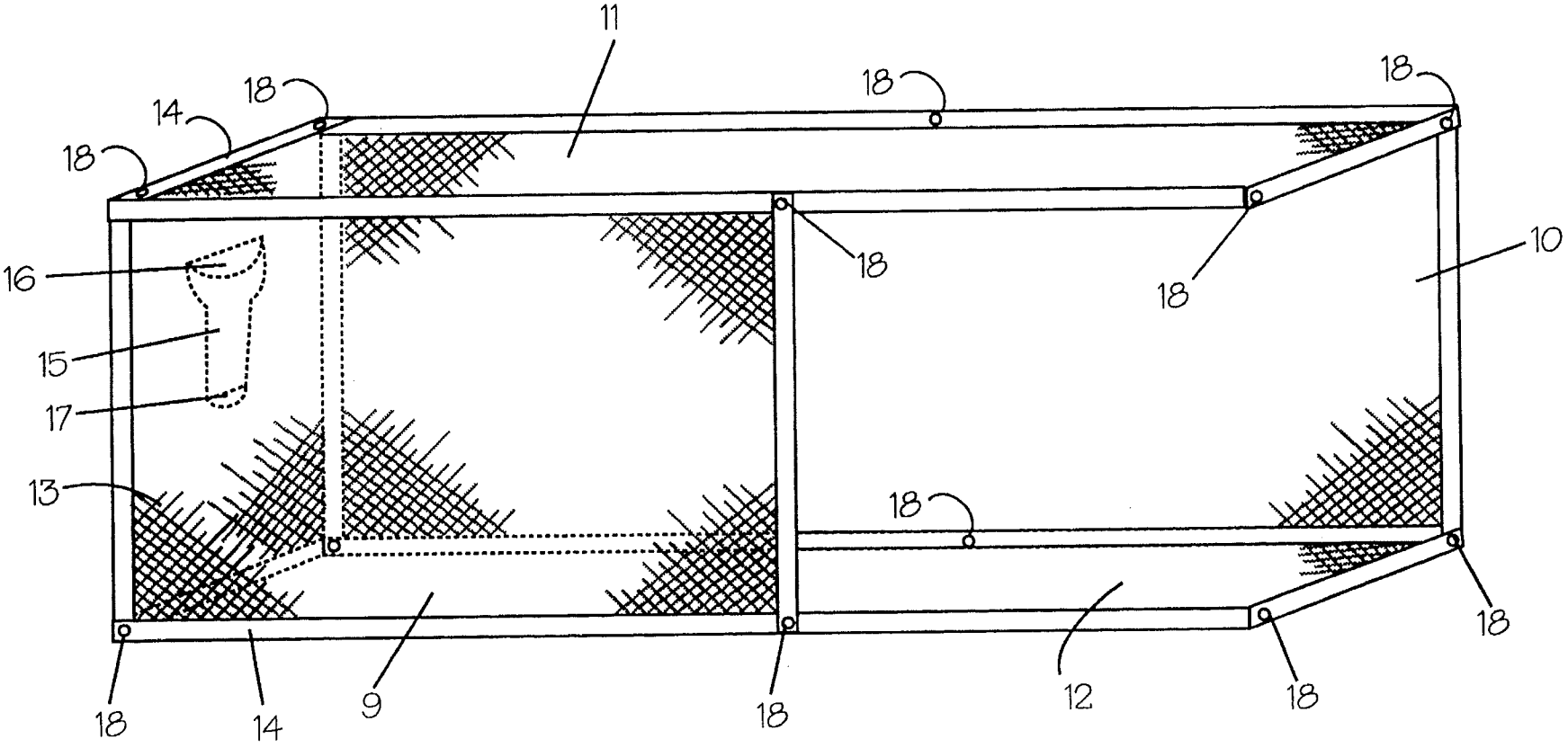
FIG. 2 shows a perspective view of the safety net when fully stretched.

Referring to FIG. 2, the safety net has a from side wall [9] (size: 3 ft.×2 ft.), a far side wall [10] (size: 5 ft.×2 ft.), a ceiling [11] (size: 5 ft.×1 ft.), and a floor [12] (size: 5 ft.×1 ft.) all of which are made of net of one-half inch mesh. The far left-hand side end of the safety net is enclosed by cloth [13] (size: 1 ft.×2 ft.) witch offers less resilience than meshed net so that ball does not bounce back too fast when it hits the cloth enclosure [13].

The from side wall [9] is only three feet long so there is a clearance of two feet on the right side. The clearance of two feet gives enough room for the follow-through of the golf club when the user chips the ball. These meshes and the cloth are sewn together by fabric bands [14]. There is an open pocket [15] shaped like a basketball basket with a four inch diameter mouth [16] and a two inch diameter bottom hole [17]. The length of the pocket is eight inches. When a golf ball is hit correctly, it goes through the bottom hole [17]. It lets the user know if he hits the ball correctly without having to head-up too quickly which is a common mistake golfers make.

Them are twelve holes [18] in the fabric band [14] and each corresponds with the holes [8] in the frame. The safety net is to be hung inside of the frame with each corresponding hole being hooked by wire hooks [19].

Figure 3:
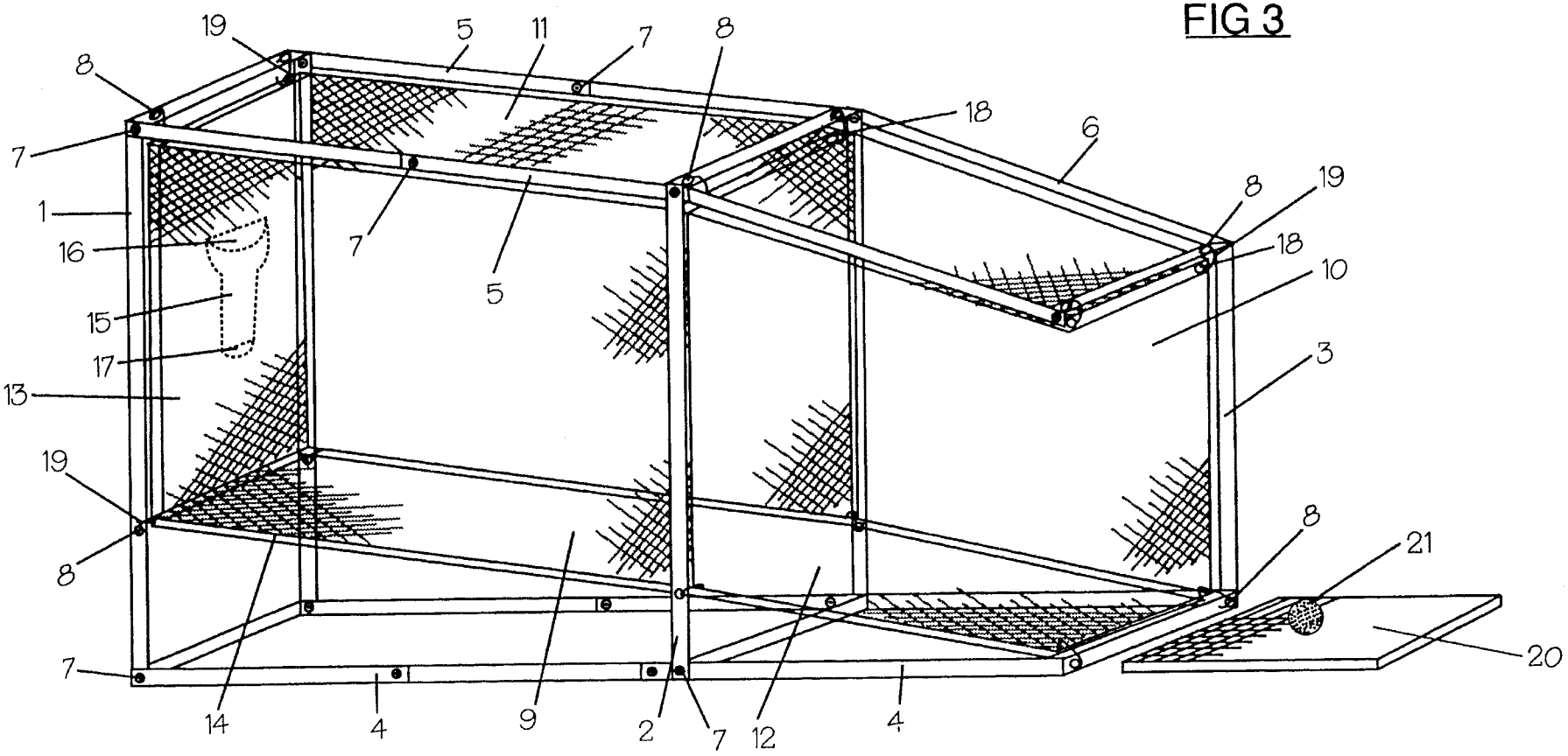
FIG. 3 shows a perspective view of the chip shot practice apparatus according to the invention with its edges simplified in lines.

Referring to FIG. 3, the safety net is placed inside of the frame. Since the top of the frame is on an incline toward fight-hand side, i.e. the first wicket [1] is taller than the second wicket [2] and the second wicket [2] is taller than the hook [3], the safety net is pitched also. Therefore, when a golf ball hits the left side of the enclosure [13], it rolls down toward the user automatically.

A hitting mat [20] is placed on the fight side of the frame and a golf ball [2]1 is placed on it.

This embodiment is distinctly advantageous since a "shanked" ball, which happens when golf ball is hit off the heel of the club head, is restrained by the far side wall and thus stays inside of the safety net, and a "topped" ball, which rolls very fast, is restrained by the floor net [12] and thus stays inside.

While the present invention has been disclosed in the connection with the preferred embodiment thereof, it should be understood that the apparatus may very in configuration as to details of the parts without departing from the basic concepts as disclosed herein.

I claim:

1. An indoor golf chip practice apparatus comprising; (a) a rectangular prism shaped safety net; said net having an opening on the end of the right-hand side; said net having a clearance of two feet on the from side wall to the right; (b) a frame to support and encompass said net having a retangular base, on the left end of said base a wicket is perpendicularly erected, on the right end of said base a hook is perpendicularly erected, and in between said wicket and said hook another wicket is perpendicularly erected on said base.

2. The apparatus mentioned in claim 1 including said net having a basketball basket shaped pocket with a mouth and a bottom hole on the middle part of the left enclosure.

3. The apparatus mentioned in claim 1 including said frame having a leveled base and also this base comprising bars crossed on each top corner of said wickets and a hook with an incline toward the right-hand side.

* * * * *